US006708418B1

(12) United States Patent
Schaefer

(10) Patent No.: US 6,708,418 B1
(45) Date of Patent: Mar. 23, 2004

(54) BRICK LAYING FORM

(76) Inventor: Larry J. Schaefer, 113 Ash Ave., Fleming, CO (US) 80728

( * ) Notice: Subject to any disclaimer, the term of this patent is extended or adjusted under 35 U.S.C. 154(b) by 0 days.

(21) Appl. No.: 10/158,759

(22) Filed: May 30, 2002

(51) Int. Cl.[7] ..... G01C 15/12
(52) U.S. Cl. ..... 33/518; 33/404
(58) Field of Search ..... 33/518, 404, 424, 33/465, 471, 613, 345, 561.1, 561.2, 561.3, 562, 563, 566, DIG. 20

(56) References Cited

U.S. PATENT DOCUMENTS

| | | | | | |
|---|---|---|---|---|---|
| 223,372 | A | * | 1/1880 | Miner | 33/518 |
| 923,313 | A | * | 6/1909 | Anderson | 33/424 |
| 966,801 | A | | 8/1910 | Daisley | 33/406 |
| 1,325,851 | A | * | 12/1919 | Kern | 33/561.3 |
| 1,880,261 | A | | 10/1932 | Larsen | 33/410 |
| 1,941,404 | A | * | 12/1933 | Lansing | 33/410 |
| 2,371,286 | A | * | 3/1945 | Eggemeyer | 33/518 |
| 2,642,674 | A | * | 6/1953 | Schell, Jr. | 33/527 |
| 2,837,910 | A | | 6/1958 | Steed | 401/22 |
| 2,883,756 | A | * | 4/1959 | Caldwell | 33/521 |
| 2,924,021 | A | * | 2/1960 | Proett et al. | 33/518 |
| 3,130,500 | A | | 4/1964 | Bongiovanni | 33/406 |
| 3,253,473 | A | * | 5/1966 | Chisholm | 74/96 |
| 3,768,167 | A | | 10/1973 | Viau | 33/406 |
| 4,275,506 | A | * | 6/1981 | Knoll | 33/561.2 |
| 4,353,171 | A | * | 10/1982 | Spears | 33/521 |
| 5,136,785 | A | * | 8/1992 | Shirley | 33/404 |
| 5,419,055 | A | * | 5/1995 | Meadows | 33/518 |
| 5,537,805 | A | * | 7/1996 | Allman | 52/749.13 |
| 5,732,474 | A | * | 3/1998 | Cannon | 33/452 |
| 5,915,809 | A | | 6/1999 | Gilliam | 33/518 |
| 6,141,882 | A | * | 11/2000 | Syken | 33/471 |
| 6,347,459 | B1 | * | 2/2002 | Schmitt | 33/561.2 |
| 6,553,683 | B1 | * | 4/2003 | Klass et al. | 33/562 |

* cited by examiner

*Primary Examiner*—Diego Gutierrez
*Assistant Examiner*—R. Alexander Smith
(74) *Attorney, Agent, or Firm*—Rick Martin; Patent Law Offices of Rick Martin, P.C.

(57) ABSTRACT

A method and apparatus for masonry brick laying of a column, such apparatus employing an apparatus for setting a layer of brick or other structural material, allowing the column of bricks to be placed in a straight, or spiral, format while keeping each layer within the column both plumb and level. Each layer of brick column can consists of a shape that can be square, rectangular, hexagonal, octagonal, etc. whereas such shape can be spiraled from one layer of brick to another. Alternate embodiment of apparatus allows a curvilinear wall to be constructed, guiding each layer of brick as the wall is constructed.

13 Claims, 7 Drawing Sheets

BRICK LAYING FORM

FIELD OF THE INVENTION

The present invention relates to a method and apparatus for a masonry guide brick laying form for use in laying of a column of bricks or other structural material. More specifically, the masonry guide allowing the column of bricks to be placed in a straight, or spiral, format while keeping each layer within the column both plumb and level.

BACKGROUND OF THE INVENTION

Masonry guides have long been used in alignment of bricks for control of successive layers. A very specific aspect of masonry is the construction of columns of bricks. Such columns are used in the support of specific structural members, decorative columns for fences or entrances, decorative mailbox support structures, and the like. In the building of any brick structure, the time and effort in keeping alignment, leveling, and placing of bricks is very time consuming. In the case where a decorative design is required, the time aspect of the job of layering the bricks is even more consuming. The use of plumb strings, external posts are labor consuming while complicated brick-laying apparatus is expensive.

What is needed is a low cost tool that would give the construction personnel ease of use, quickness in brick layering, exactness in incrementally layering for decorative spiraled construction, and uniform mortar thickness throughout the construction.

The apparatus of the present invention provides the above needs as will be described in the following embodiment.

SUMMARY OF THE INVENTION

The main aspect of the present invention is to provide for an apparatus to control the layering of bricks in a straight or spiraled brick column.

Another aspect of the present invention is to provide for ease of adjustment and control when placing a layer of brick with respect to a previous layer.

Another aspect of the present invention is to provide for a variable amount of layers of brick (tiers) per 360° of spiral rotation within a spiral shaped column.

Another aspect of the present invention is to provide for control of overall dimensions per layer with respect to the bricks and the mortar used.

Another aspect of the present invention is to provide for an apparatus that is adjustable for various sizes manufactured bricks.

Another aspect of the present invention is to provide an apparatus that is low in cost and easy to manufacture.

Another aspect of the present invention is to provide and apparatus that provides for timesaving in construction of a spiraled column.

Another aspect of the present invention is to provide for a hexagonal, octagonal, etc. column design.

Other aspects of this invention will appear from the following description and appended claims, reference being made to the accompanying drawings forming a part of this specification wherein like reference characters designate corresponding parts in the several views.

The main embodiment of the present invention consists of a square shaped layer adjustable jig (LAJ) that allows for control of the layering of bricks or other structural material in straight or spiral column designs. Each layer of brick can be offset or plumb with respect to the previous layer of brick.

Alternate embodiments of the present invention allow for rectangular shaped, round shaped, hexagonal, octagonal or curved shaped layer adjustable jigs for various brick layering designs. Each shape can be built in a straight-up column or can be built with a spiral shape as the column progresses upward.

DETAILED DESCRIPTION OF THE INVENTION

The apparatus of the present invention consists of a layer adjustable jig (LAJ) that allows for control of the layering of bricks or other structural material in a straight or spiral column designs. Each layer can be offset or plumb with the previous layer. Thus a column could be constructed with various designs, including but not limited to:

1. Square or rectangular;
2. Spiraled with each level being square or rectangular;
3. Hexagonal or octagonal with each level plumb to the previous level;
4. Hexagonal or octagonal with each layer offset by 9° or multiple of 9° from layer to layer.

Construction of the column would consist of the following basic steps:

A. Construction of a base footer and placing a center post in a fixed position in the base footer of the column to be constructed, the center post could be either round or rectangular in shape and extend the height of the column;

B. Plumbing the center post vertically and horizontally in its fixed position;

C. Attaching the LAJ to the center post above the layer to be placed;

D. Laying a level of mortar in the base position of the column such that the front base edges are parallel to a street or reference wall;

E. Placing the "first" layer of brick lightly on the mortar with ends mortared and then using the LAJ as a position guide for rough (eyeball) brick placement;

F. Lowering the LAJ onto the mortared bricks for establishing a final alignment;

G. Moving the LAJ upward, locking it in place, and then rotating the LAJ to the desired angle using the index wheel of the LAJ for the "next" layer of brick with respect to the "last" layer of brick;

H. Placing a layer of mortar over the top of the "last" layer of brick;

I. Laying the "next" layer of mortar then brick using the preset LAJ as a brick-positioning guide;

J. Proceeding as per step "G" through "I" above for subsequent layers of brick up to the last 2–4 layers;

K. Removing the LAJ prior to the last 2–4 layers, which would be completed manually.

The construction would begin with a center post placed within the column area to be constructed. The center post (round or square) would be placed in a permanent position and leveled in both vertical and horizontal dimensions. The LAJ would attach/detach to the center post by means of a post guide. A locking center post cam would hold the LAJ in place vertically and a center post guide would hold the LAJ in place horizontally. The center post guide would be constructed to have an opening, which would allow it to mount around the center post. In the cases where there would be no obstacles above the column to be built an alternate means of construction would entail using a removable shaft over a smaller center post. For example, a two inch (square or round) diameter base center post of length 6"–36" or so, would be mounted in the base. Then a slide-over post with an inside dimensions slightly larger than the base center post would slide over the base center post. The LAJ would then mount on the slide-over post to be used during construction and would then remove from the column top after completion of the column.

Center posts can be of variable sizes but the most economic manufacture of the LAJ would be to use center posts within a specific range such that the LAJ would have a standard manufacturing size with regard to the area that attaches to the center post.

The LAJ would provide for control of several aspects when moving from one layer of the column to the next. The LAJ would control:

A. The rotational angle within a 360° spiral.

B. Dimension control of each layer with respect to the center post.

C. Dimensional control within of each layer with respect to the layer dimensions (bricks and mortar) itself.

D. Ability to adjust (or not adjust) each subsequent layer by a multiple of about 9° or an angle that would divide equally into 180°.

The LAJ is constructed to have an index wheel circumferentially attached to its post guide. The index wheel would have index holes. For example, index holes positioned about every 9° would provide for 40 layers of brick (tiers) per 360° spiral within a column. If layers were incremented every 6°, there would be 30 layers per 180° rotation. Thus, the number of layers per complete rotation can be controlled as well as the angle of rotation from one layer of brick to the next.

The LAJ is designed to provide for control of overall dimensions per layer with respect to the bricks and the mortar used. Both the inner and outer frame members of the LAJ have adjustable mating points to accommodate various size bricks. The adjustment, once made, will keep a constant distance between the bricks and the center post, between the outside dimensions of the layer, mortar spacing, etc.

The LAJ employs a design that is easy to manufacture and low in cost. The LAJ is simple to use, readily attachable/detachable to the preset center post, easily moved upward or downward on the center place, and locks in place to the center post via a simple locking cam. The design of the LAJ provides for timesaving in construction of a spiraled column without the need of a highly skilled mason.

The LAJ can provide for ease of construction of various type columns. Each layer can be square, rectangular, hexagonal, octagonal, etc. Each subsequent layer within the column can be spiraled at a controlled angle with respect to the previous column.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF DRAWINGS

Figure 1:
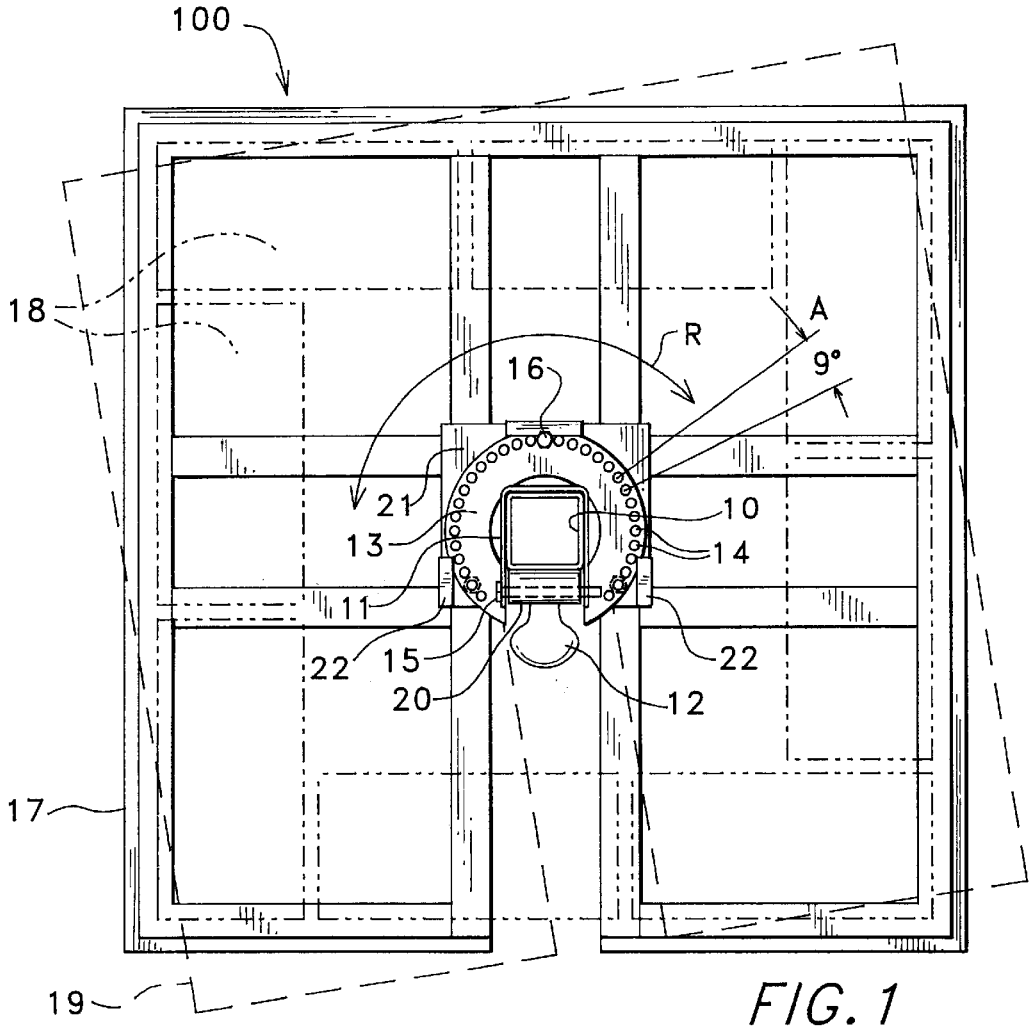
FIG. 1 is a top view of the LAJ, the preferred embodiment of the present invention, attached to a center post and in a 9° rotational position with respect to a layer of brick.

FIG. 1 is a top view of the LAJ 100, the preferred embodiment of the present invention, attached to center post 10 and with a 9° rotational position A depicted with respect to a layer of bricks 18. LAJ 100 can rotate about the layer of bricks 18 in axis R. LAJ 100 is attached to center post 10 by post guide 11 which is held in place by cam 20 when locking cam handle 12 is rotated in an horizontal position. Cam 20 is shown in the locked (horizontal) attached to post guide 11 by cam-to-post guide locking pin 15. When cam 20 is in the unlocked (locking cam handle 20 vertical) position, LAJ 100 can be moved upward or downward along center post 10. Index wheel 13 is rigidly attached to guide post 11 and contains index holes 14, which are typically offset by 9° angle A. LAJ frame 17 is rigidly attached to frame plate 21. Index wheel 13 allows frame plate 21, and thus LAJ frame 17, to rotate within the three frame-to-index wheel guide and supports 22 which also function to support LAJ frame 17, allowing support LAJ frame 17 to hang from index wheel 13. Index wheel to frame plate locking pin 16 is inserted into one of index holes 14 and through one hole in frame plate 21 (not visible) to lock frame plate 21 to index wheel 13. Frame plate 21 (and thus LAJ frame 17) can thus rotate about index wheel 13 (and thus center post 10) in 9° A increments by lifting frame plate locking pin 16, rotating LAJ frame 17 to the desired rotational position and resetting frame plate locking pin 16. FIG. 1 shows (dotted lines) LAJ frame 17 rotated to a new rotational position 19. It should be noted that although index wheel 13 is depicted with 9° increments, it is relatively simple to adjust the design parameters to other incremental angles by changing the position of the wheel index holes.

Figure 2:
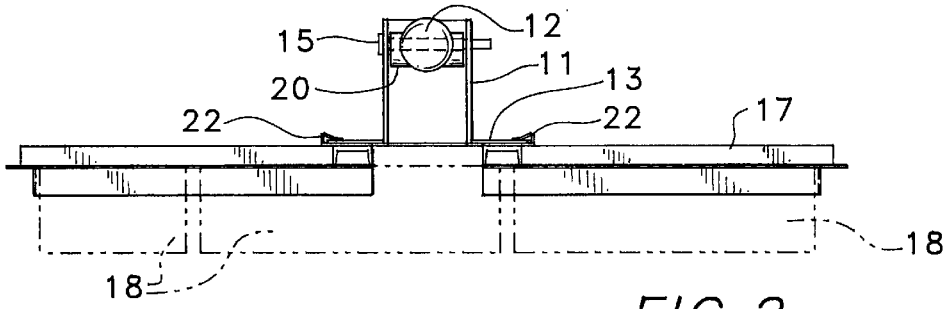
FIG. 2 is a side view of the LAJ.

FIG. 2 is a side view of LAJ 100 in position placed above layer of bricks 18. Shown is the frame-to-index wheel guide and support 22 that holds index wheel 13 in place allowing rotation of LAJ frame 17. Also shown is cam-to-post guide locking pin 15 that attaches cam 20 to post guide 11. It should be noted that although the frame-to-index guide and support 22 is depicted as a C-shaped slot design in three locations, it is relatively simple to change the design to various length slots or other design while maintaining its relative function to contain index wheel 13 when LAJ frame 17 is in one of various rotational positions with respect to post guide 11.

Figure 3:
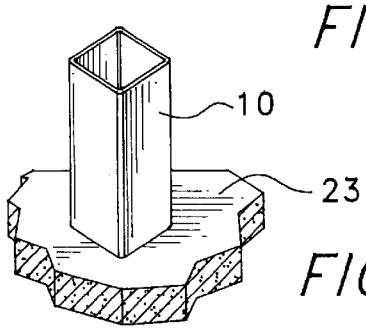
FIG. 3 is a front perspective view of the center post.

FIG. 3 is a front perspective view of the center post 10 rigidly attached to base post footer 23. As previously discussed, center post 10 would be set into base post footer 23 in a plumbed position, that is, leveled in a vertical and horizontal position and would have the length required for the column construction.

Figure 4:
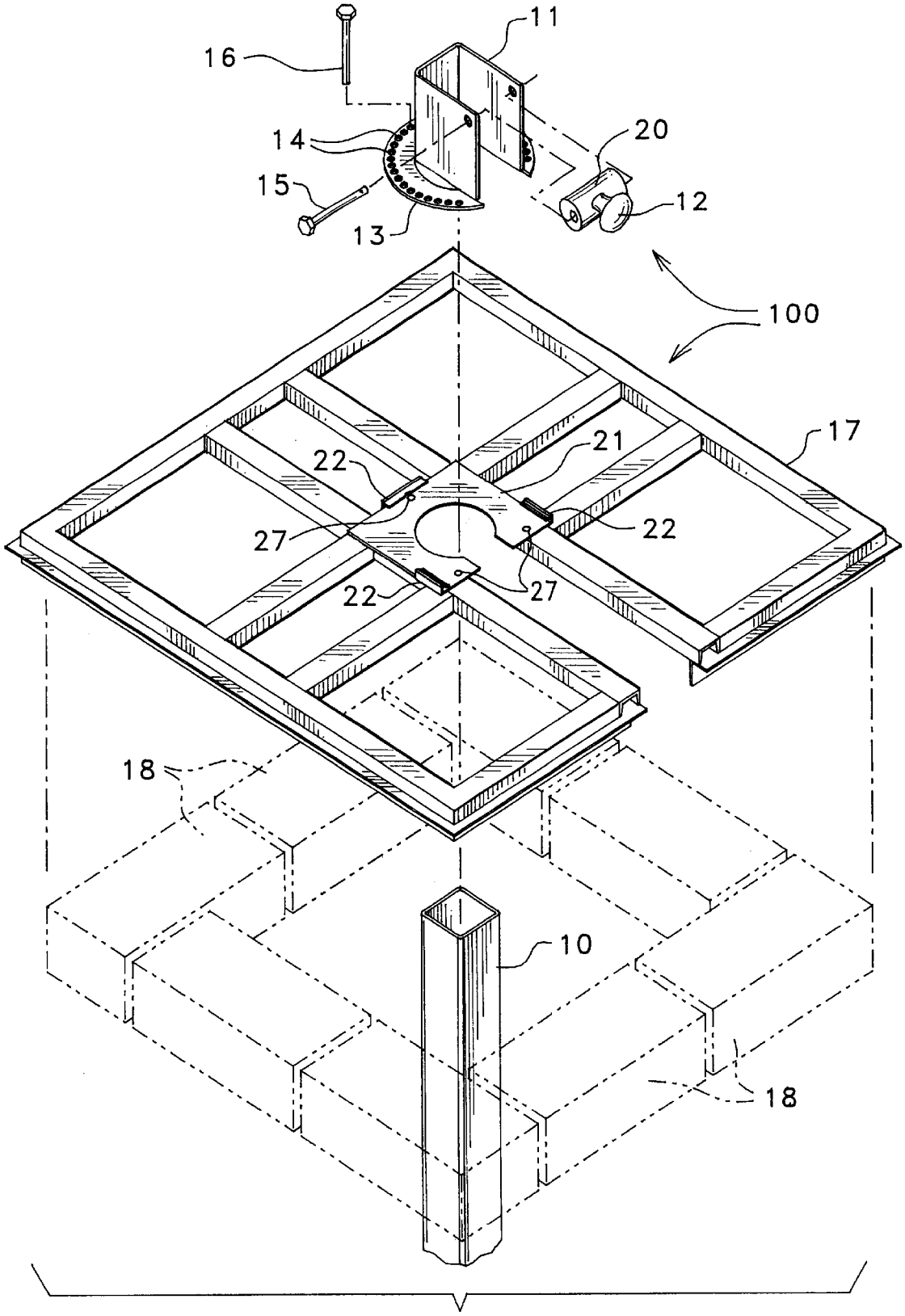
FIG. 4 is an exploded front perspective view of the LAJ, center post, and a layer of brick.

FIG. 4 is an exploded front perspective view of LAJ 100, center post 10, and a layer of bricks 18. Frame plate 21 is rigidly mounted to LAJ frame 17. LAJ frame 17 contains three frame-to-index wheel guide and supports 22 and three frame plate locating holes 27. Frame-to-index wheel guide and supports 22 serve to enclose index wheel 13, which is rigidly attached to post guide 11, allowing frame plate 21 (and thus LAJ frame 17) to rotate about post guide 11 (and thus rotate about center post 10). Index wheel to frame plate locking pin 16 holds the assembly from rotation when in place. Cam to post guide locking pin 15, when removed, allows cam 20 to be removed, thereby providing an opening allowing LAJ 100 to be removed from center post 10. It should be noted that although only one index wheel to frame plate locking pin 16 is shown, two others could be used for securing index wheel 13 to frame plate 21 within frame plate locating holes 27.

Figure 5:
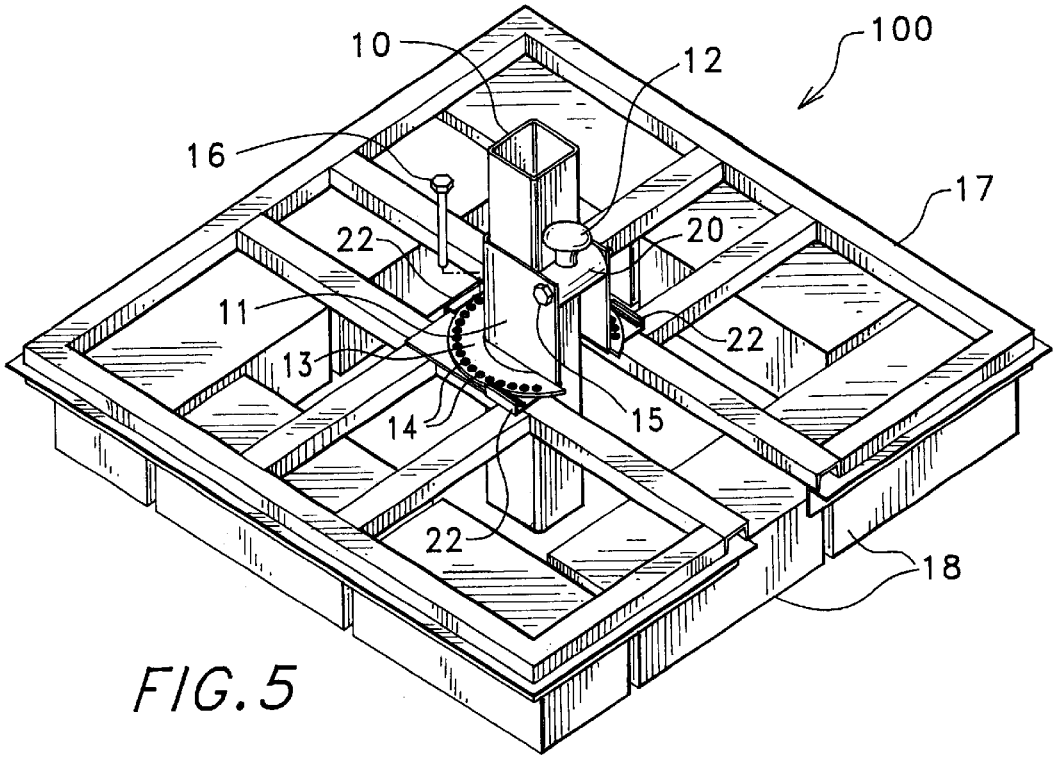
FIG. 5 is a front perspective view of the LAJ positioned over a layer of bricks.

FIG. 5 is a front perspective view of LAJ 100 positioned over layer of bricks 18. Locking cam handle 12 is shown in the vertical position (unlocked) and, as such, LAJ 100 can be moved in a direction upward on center post 10 (see FIG. 6).

Figure 6:
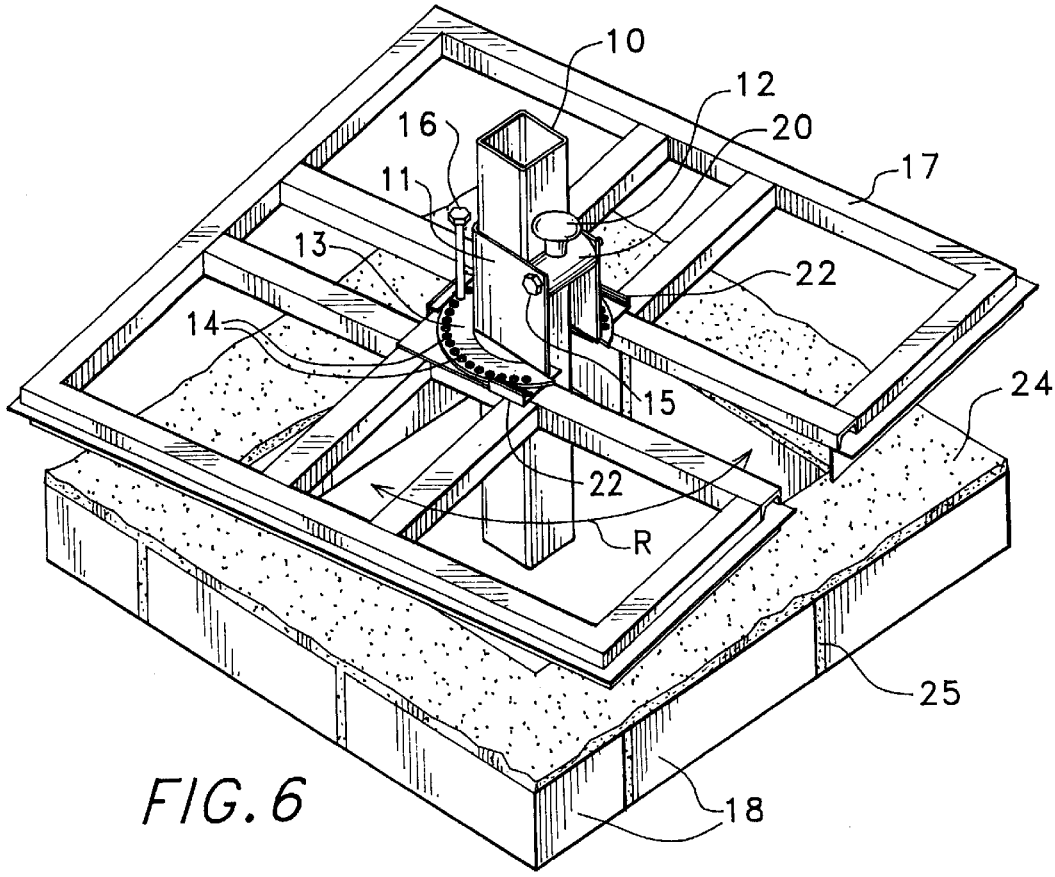
FIG. 6 is a front perspective view of the LAJ placed in a rotational position respect to a subsequent layer of brick. It is ready to be used as a visual guide to roughly position the next row of bricks.

FIG. 6 is a front perspective view of LAJ 100 placed in a rotational position with respect to a subsequent layer of bricks 18. Layer of bricks 18 is shown with inter-brick mortar 25 and top mortar layer 24. LAJ 100 is shown in a raised position over layer of bricks 18 with LAJ frame 17 rotated in a counterclockwise position along rotational axis R. Rotation is achieved by lifting index wheel to frame plate locking pin 16, rotation LAJ frame 17 the desired number of increments, then replacing frame plate locking pin 16. Once LAJ 100 is at the desired height locking cam handle 12 is positioned in the locking (horizontal) position to hold LSJ 100 into place along center post 10.

Figure 7:
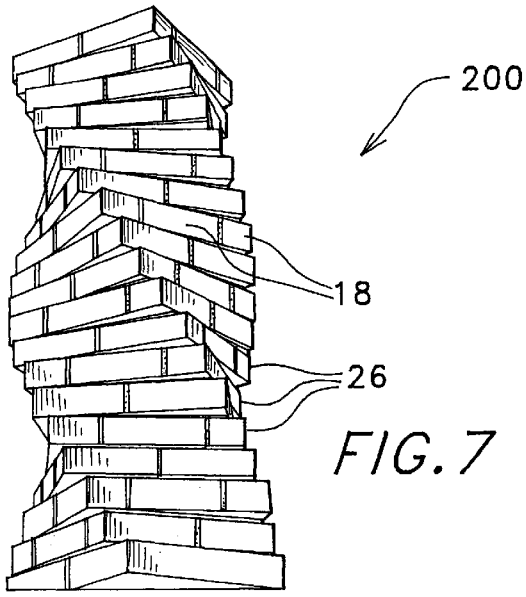
FIG. 7 is a perspective view of a portion of a completed spiral column.

FIG. 7 is a perspective view of a portion of completed spiral column 200. Respective rotated brick layers 26 are located at a rotational angle relative to each individual layer of bricks 18. The angle of rotation is determined as previously described. It should be noted that LAJ 100 could be easily used to build a non-spiraled column by election to only raise LAJ 100 along center post 10 without rotating LAJ frame 17 with respect to center post 10.

Figure 8:
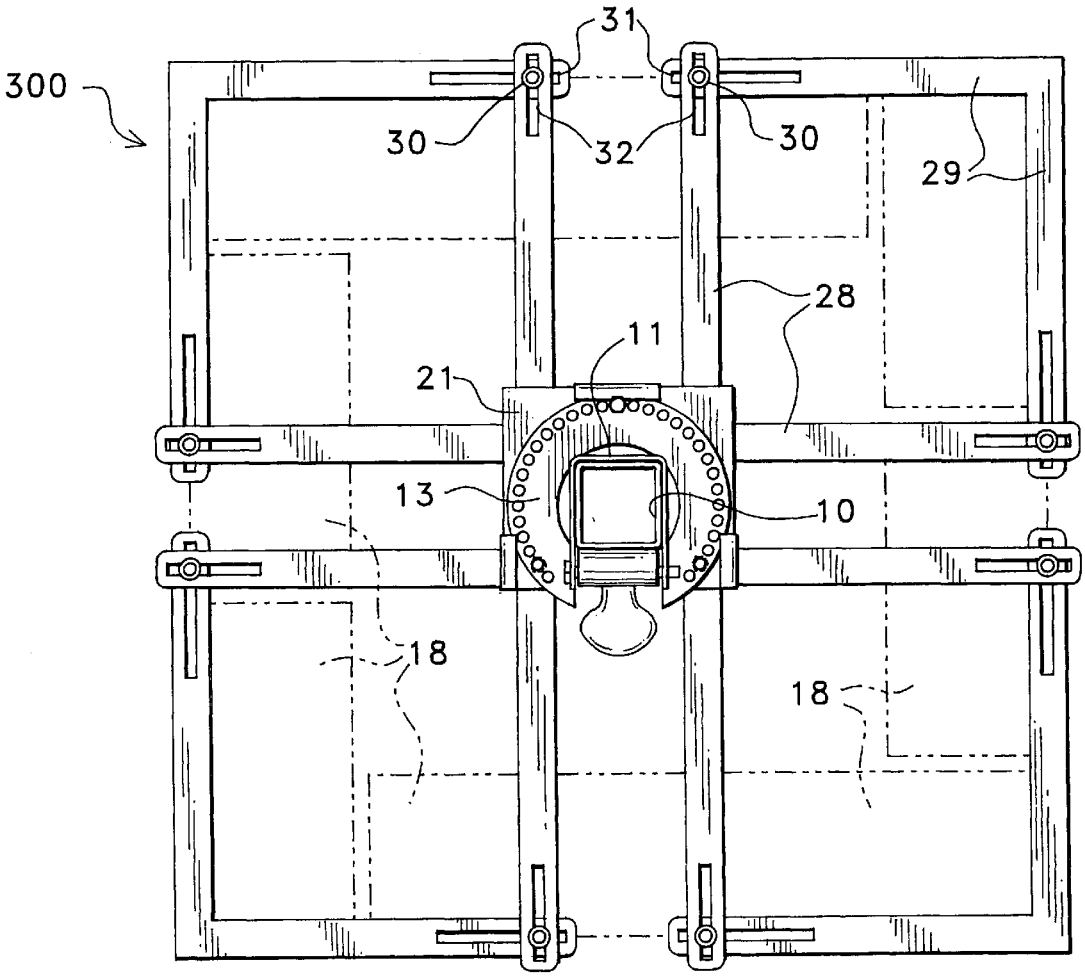
FIG. 8 is a top view of an adjustable LAJ, an alternate embodiment of the present invention, positioned over a layer of bricks.

FIG. 8 is a top view of layer adjustable and variable jig LAVJ 300, an alternate embodiment of the present invention, positioned over layer of bricks 18. In this alternate embodiment, LAJ frame 17 is replaced with an adjustable frame consisting of inner frame members 28 and outer frame members 29. Inner frame members 28 have adjustment slots 32. Outer frame members 29 have adjustment slots 31. Inner frame members 28 are held in place to outer frame members 29 by slot locking pins 30. This alternate embodiment of the present invention allows for an adjustable frame to accommodate various size brick dimensions that effect the length and with of the outer body with respect to location from center post 10. Construction is otherwise similar to LAJ 100 previously described.

Figure 9:
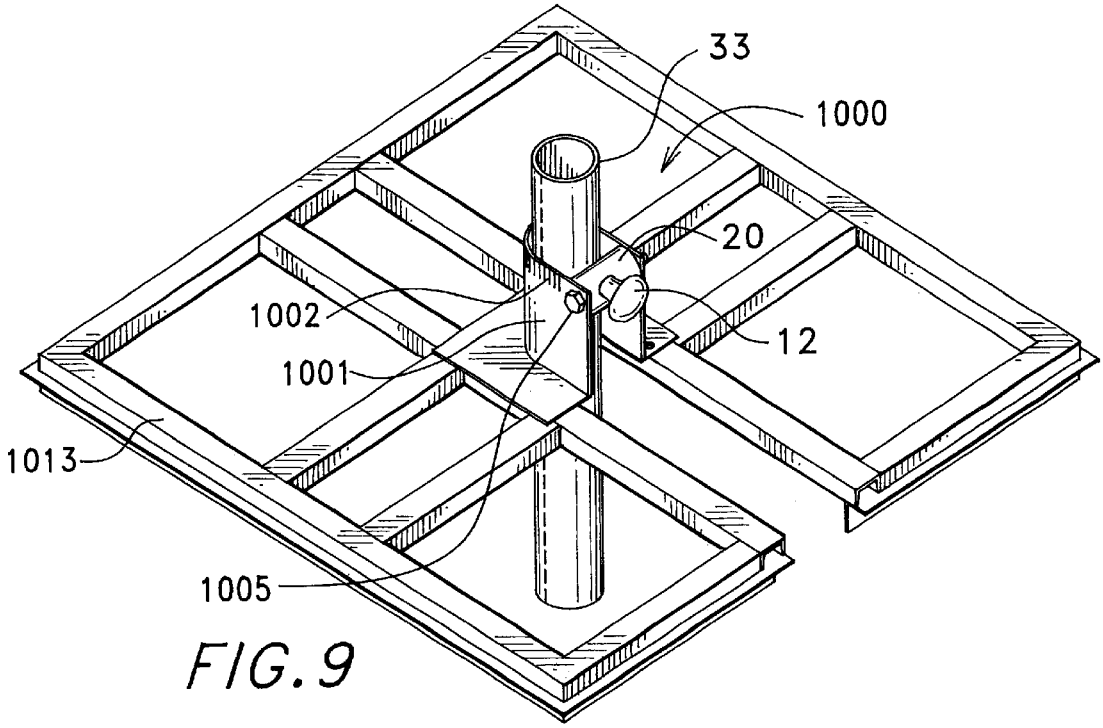
FIG. 9 is a front perspective view of the LAJ attached to a round center post.

FIG. 9 is a front perspective view of an alternate embodiment LAJ 1000 attached around center post 33. Locking cam handle 12 is shown in a horizontal (locking) position to secure cam 20 to round center post 33. An equivalent lock would be a simple bolt and turning handle. This simplified embodiment has a U-shaped center post guide 1001 which may have angle markings 1002 to locate the offset of each layer of brick when spiraling. The entire frame 1013 rotates with the guide 1001 for use the same as the preferred embodiment of FIG. 1. This is a less expensive device to build. A square post could be accommodated by adjusting a cross-bolt 1005 to lock the U-shaped guide 1001 around the corners of a square post.

Figure 10:
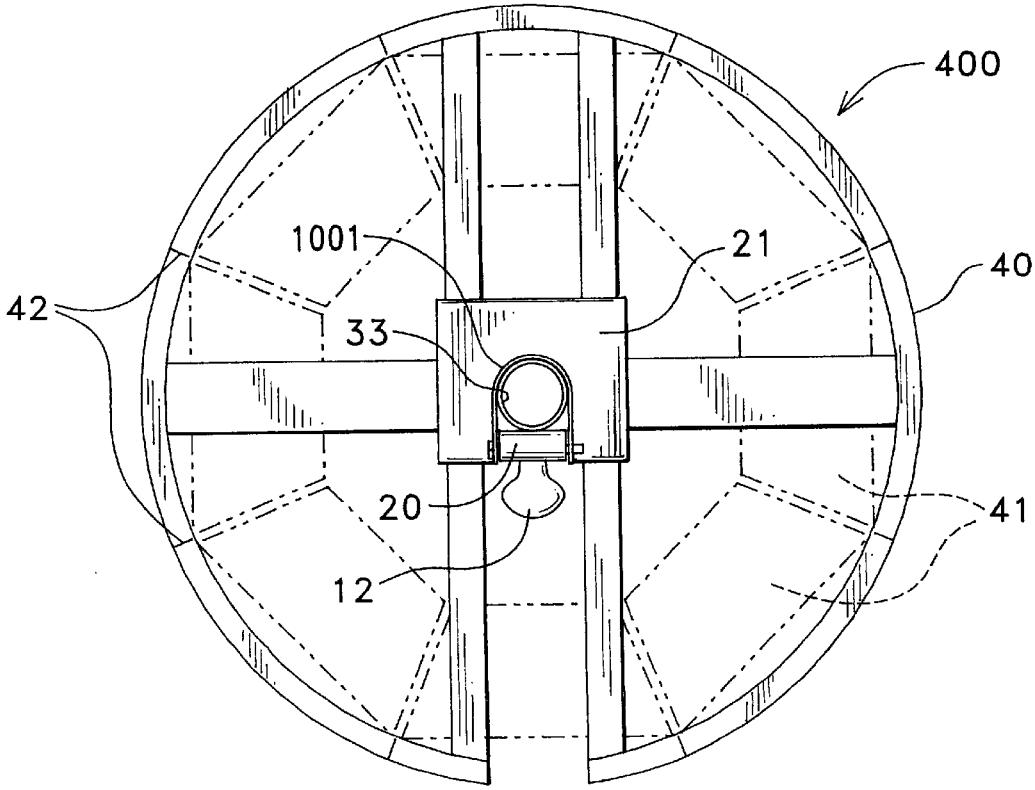
FIG. 10 is a top view of a round shaped layer position jig, yet another alternate embodiment of the present invention.

FIG. 10 is a top view of a round shaped layer position jig 400, an alternate embodiment of the present invention. Round frame 40 is the only basic difference between round shaped layer position jig 400 and LAJ 100. Frame plate 21 is rigidly attached to round frame 40. Frame plate 21, cam 20, locking cam handle 12, post guide 11, etc. are all the same as previously described. Thus the detachable parts, round frame 40 and frame plate 21 are interchangeable with and can be readily removed and replaced with a square or rectangular frame assembly as previously described. Shown are pre-cut bricks 41 which could be assembled in an octagonal layer. Brick edge location guides 42 are positioned to align each brick around the periphery of round frame 40. Each octagonal layer could be offset from each subsequent octagonal layer by rotation of round frame 40 with respect to angle markings (not shown) in the same manner as previously described in FIG. 9 above. Thus round shaped layer position jig 400 can be used to build a straight up octagonal layered column or can be used to build a spiraled octagonal layered column. It should be noted that although a octagonal layer is depicted in the drawing of FIG. 10, other shaped, such as hexagonal, can readily be constructed depending on the size and pre-cut dimensions of the bricks to be used. Also, as previously described FIG. 9 above, a square post could be accommodated by adjusting a cross-bolt to lock the U-shaped guide 1001 around the corners of a square post.

Figure 11:
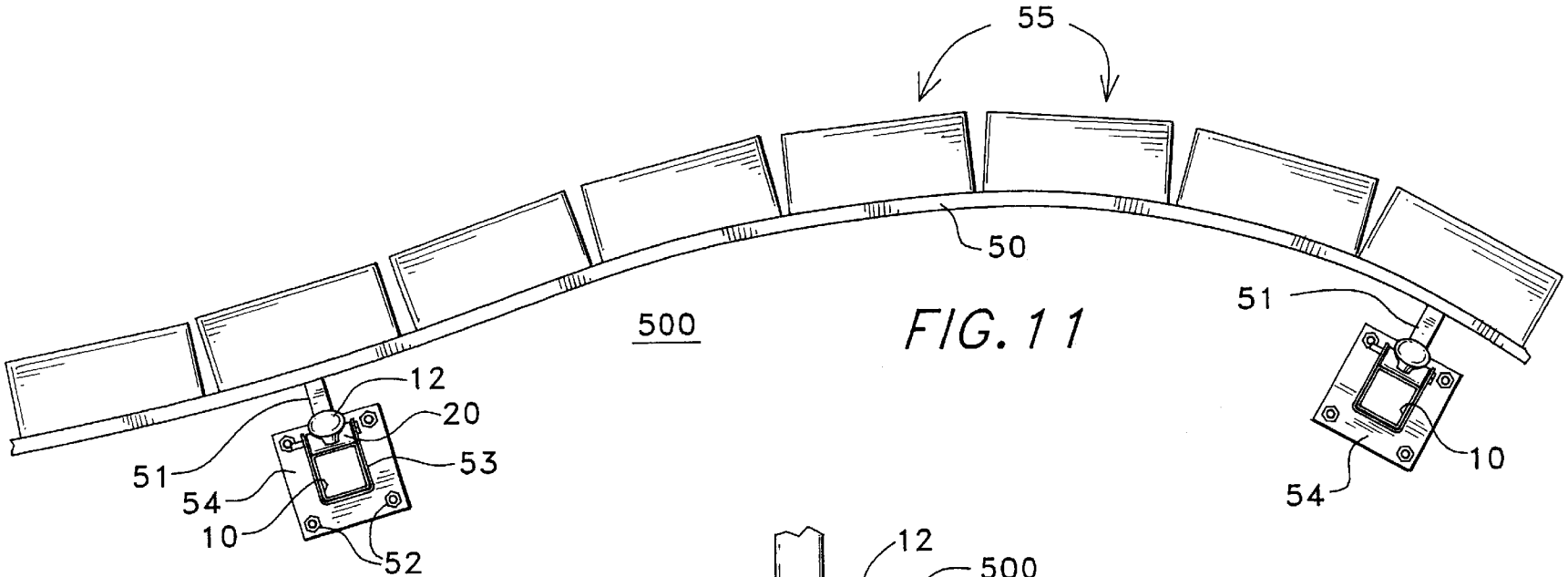
FIG. 11 is a top view of a curve shaped layer position jig, yet another alternate embodiment of the present invention.

FIG. 11 is a top view of curve shaped layer position jig 500, yet another alternate embodiment of the present invention. Curve shaped layer position jig 500 is a design for construction of a curve shaped structure using the same basic concept in moving the form up center post 10 as previously described. The curvilinear shape of curve guide jig 50 determines the basic curve of curve brick wall 55 to be constructed. Depending on the size of flanged curve guide jig 50, there would be at least two points of connection to post guides 53. Flanged curve guide jig 50 is rigidly attached to curve guide post attach arm 51, which in turn, is rigidly attached to modified post guide 53. Cam 20 and locking cam handle 12 are used to move flanged curve guide jig 50 up center post 10 (as previously described) as curved brick wall 55 is constructed. Center post base plates 54 are attached to a footer via assembly 52 (nuts and bolts). It should be noted that the post guide 53 could be constructed such that locking cam handle 12 would be accessible on any side other than that shown.

Figure 12:
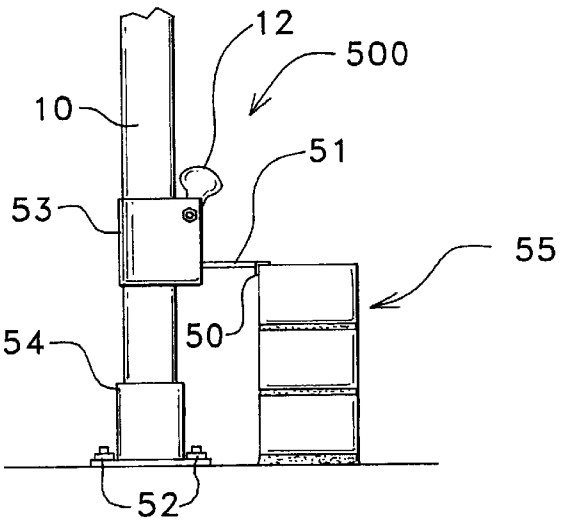
FIG. 12 is a side view of the curve shaped layer position jig of FIG. 11, an alternate embodiment of the present invention.

FIG. 12 is a side view of curve shaped layer position jig 500 (see FIG. 11), an alternate embodiment of the present invention. In this view, modified post guide 53 is shown attached to center post 10 in a position with curved brick wall 55 having three tiers. Center post 10 is seated within center post base plate 54. As stated previously, it should be noted that post guide 53 could be constructed such that locking cam handle 12 would be accessible on any side other than that shown.

Figure 13:
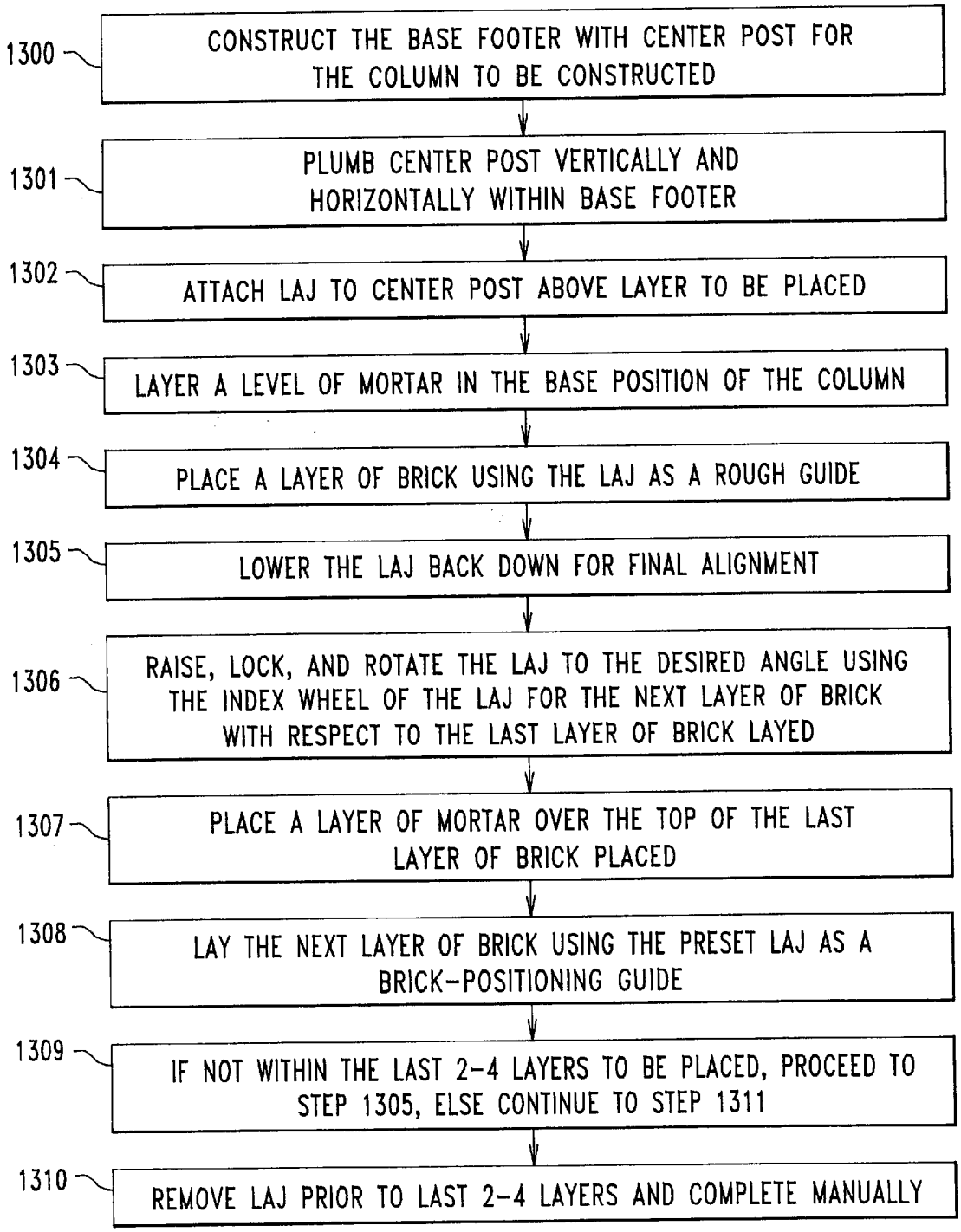
FIG. 13 is a flow chart of the basic process to be followed in use of the LAJ or alternate embodiments of the present invention.

FIG. 13 is a flow chart of the basic process to be followed in use of the LAJ or alternate embodiments of the present invention.

In FIG. 13, the following steps of the process are described as:

Step 1300—Construct the base footer and placing a center post in a fixed position in the base footer of the column to be constructed.

Note: The center post could be either round or rectangular in shape and extend the height of the column;

Step 1301—Plumb center post vertically and horizontally within base footer;

Note: Post should be hardened into place before proceeding, for example, the concrete should be hard.

Step 1302—Attach LAJ to the center post above layer to be placed;

Note: Allow room to lightly place bricks below the LAJ position.

Step 1303—Layer a level of mortar in the base position of the column;

Note: The front base edges should be parallel to a street or reference wall.

Step 1304—Place a layer of brick lightly on the mortar and add mortar between the bricks using the LAJ as a rough guide;

Note: Final brick placement will be per LAJ setup.

Step 1305—Lower the LAJ back down for final brick alignment.

Step 1306—Raise, lock, and rotate the LAJ to the desired angle using the index wheel of the LAJ for the "next" layer of brick laid;

Note: The LAJ should be in the proper position with respect to the "last" layer of brick.

Step 1307—Mortar over the top of the "last" layer of brick;

Step 1308—Lay the "next" layer of brick using the preset LAJ as a brick-positioning guide;

Step 1309—If not within the last 2–4 layers to be placed, proceed to step 1305, else continue to step 1310.

Note: Depending on the overhead clearance, the LAJ should be left on for as many brick tiers as possible.

Step 1310—Remove LAJ prior to the last 2–4 layers which would be completed manually.

Note: Again, the LAJ should be left on for as many brick tiers as possible.

Once the column is completed, the LAJ can be used over and over for subsequent columns.

Although the present invention has been described with reference to preferred embodiments, numerous modifications and variations can be made and still the result will come within the scope of the invention. No limitation with respect to the specific embodiments disclosed herein is intended or should be inferred.

I claim:

1. In combination with a center post that provides a guide for an array of structural modules, an improvement comprising:

a center post guide formed to fit around the center post;

said center post guide having an index wheel with a plurality of index holes, arranged circumferentially;

said center post guide having a lock assembly for locking at specified heights the center post guide to the center post;

a structural module alignment frame having an outer periphery to align a layer of structural modules;

said structural module alignment frame having a centrally located plate with an alignment hole to align with a hole of the index wheel;

a pin to lock the holes of the index wheel and the centrally located plate; and wherein a user can lay a first layer of structural modules, then raise and lock the center post guide to a new height to accommodate a second layer of structural modules, and the user can rotate the structural module alignment frame, and set the pin to a chosen set of aligned holes, thereby creating a desired pattern of structural modules.

2. The improvement of claim 1, wherein the centrally located plate further comprises a frame to index wheel guide and support to enable the structural module alignment frame to hang from the index wheel and to rotate symmetrically around.

3. The improvement of claim 1, wherein the structural modules comprise bricks.

4. The improvement of claim 1, wherein the lock assembly further comprises an axle mounted to the center post guide, a cam mounted to the axle and a handle mounted to the cam.

5. The improvement of claim 1, wherein the outer periphery defines a rectangle.

6. The improvement of claim 1, wherein the outer periphery defines a circle.

7. The improvement of claim 5, wherein the structural module alignment frame further comprises an adjustable outer periphery size assembly.

8. The improvement of claim 1, wherein the desired pattern is a spiral.

9. A brick guide comprising:

a center post guide formed to fit around a stationary center post;

said stationary center post being rigidly attached to a base;

said center post guide having a lock assembly for locking at specific heights on the stationary center post as well as at variable circular angles relative to the stationary center post;

a brick alignment frame attached to the center post guide; and said brick alignment frame having a defined outer periphery, wherein a bricklayer is enabled to lay a first layer of bricks, then raise the brick alignment frame to lay a second layer of bricks in a chosen alignment with the first layer of bricks.

10. The brick guide of claim 9, wherein the brick alignment frame has an adjustable size outer periphery.

11. A lock guide comprising:

a center post guide means functioning to encircle a fixed center guide post;

said center post guide means having a lock means functioning to adjustably lock the center post guide means to the fixed center post guide at chosen heights;

said center post guide means having an index means functioning to enable a block frame means to adjustably rotate about the center post guide means and lock at a chosen rotational angle;

the block frame means functioning to provide a peripheral alignment for a layer of blocks; and a support means functioning to connect the block frame means to the center post guide means.

12. A brick guide comprising:

a center post guide formed to fit around a stationary center post;

said center post guide having a lockable rotational assembly for rotating around the center post;

said center post guide having a lock assembly for locking at specific heights on the stationary center post;

a brick alignment frame attached to the center post guide; and the brick alignment frame having a defined outer periphery to lay a first layer of bricks, then raise the frame, then lock the frame at a chosen rotational alignment, to lay a second layer of bricks at the chosen rotational alignment to the first layer of bricks.

13. A method to construct a column comprising the steps of:

a) constructing a base footer having a center post;

b) attaching a center guide post to the center post in a lockable fashion;

c) mounting and locking a rotatable frame on the center guide post at a selected rotational angle;

d) laying a layer of blocks using the frame as a guide;

e) moving the frame upward on the center post, locking it in place and adjusting its rotational angle;

f) laying a layer of mortar atop the layer of blocks;

g) placing a second layer of blocks over the top of the mortar;

h) repeating steps d–g; and i) wherein said rotatable frame has a peripheral edge defining a peripheral edge of the blocks.

* * * * *